US006722075B1

(12) United States Patent
Gabaldon

(10) Patent No.: US 6,722,075 B1
(45) Date of Patent: Apr. 20, 2004

(54) COMPACT OFFSET SIGHTING DEVICE

(76) Inventor: Raymond P. Gabaldon, 4093 Matthews Pl., Ft. Knox, KY (US) 40121

( * ) Notice: Subject to any disclaimer, the term of this patent is extended or adjusted under 35 U.S.C. 154(b) by 0 days.

(21) Appl. No.: 10/354,546

(22) Filed: Jan. 30, 2003

(51) Int. Cl.[7] ..... F41G 1/16; F41G 1/033

(52) U.S. Cl. ..... 42/141; 42/136; 42/137; 42/140; 42/148

(58) Field of Search ..... 42/112, 133, 135, 42/136, 137, 138, 139, 140, 141, 148

(56) References Cited

U.S. PATENT DOCUMENTS

| | | | | | |
|---|---|---|---|---|---|
| 706,390 | A | * | 8/1902 | Collins | |
| 857,160 | A | * | 6/1907 | Cremer | |
| 878,857 | A | * | 2/1908 | Bevier | 42/137 |
| 3,165,836 | A | * | 1/1965 | Magardo | |
| 3,930,316 | A | | 1/1976 | Tellie | |
| 3,961,423 | A | | 6/1976 | Hrebar | |
| 3,969,827 | A | * | 7/1976 | Ellis | 33/255 |
| 4,102,053 | A | | 7/1978 | Colwell | |
| 4,597,211 | A | | 7/1986 | Miles | |
| 4,677,782 | A | | 7/1987 | Kaye et al. | |
| 4,689,910 | A | * | 9/1987 | Choate et al. | 33/255 |
| 4,799,325 | A | | 1/1989 | Booze | |
| 4,905,396 | A | | 3/1990 | Bechtel | |
| 4,962,589 | A | | 10/1990 | LaRosa | |
| RE33,485 | E | | 12/1990 | Frimer | |
| 5,481,818 | A | | 1/1996 | Stover | |

* cited by examiner

*Primary Examiner*—Stephen M. Johnson
(74) *Attorney, Agent, or Firm*—DeWitt M. Morgan

(57) ABSTRACT

An offset sighting device for a weapon such as an M16 rifle for use with an NBC mask or equivalent. The sighting device includes front sight, rear sight, and a mechanism for supporting both. The site support includes a bracket, and a front sight support arm pivotally connected to the bracket to permit the front sight to be moved from a closed position adjacent to the bracket to an operational position. The sight support further includes a rear right support arm pivotally connected to the bracket to permit the rear sight to be moved from a position adjacent to the bracket to an operational position in alignment with the front sight. The sighting device also includes a mechanism for attaching the bracket to the rifle.

12 Claims, 2 Drawing Sheets

COMPACT OFFSET SIGHTING DEVICE

FIELD OF THE INVENTION

The present invention relates to a weapon sighting device, particularly adapted for shoulder fired weapons such as the M16 rifles, which is mounted off to one side of the weapon's's barrel. Such a sighting device permits a soldier wearing an NBC (nuclear, chemical and biological) type mask (or equivalent) to accurately aim the weapon.

BACKGROUND OF THE INVENTION

Various sighting devices are known for weapons. In the M16 rifle, for example, the built in sighting apparatus includes an aperture sight which is mounted above the trigger in the carrying handle of the rifle, and a pointer mounted at the end of the barrel. Aiming of the weapon is accomplished by visually aligning the aperture and the pointer (both of which are adjustable) on the target.

In current ground-based warfare (including warfare in nuclear, chemical and biological environments), soldiers are typically armed with the M16 series rifle. Where there is a threat of chemical or biological agents, soldiers are currently required to initiate combat while wearing an NBC protective mask and clothing. Such clothing prevents a soldier's exposure to harmful chemical or biological agents, which would otherwise enter the human body through, for example, the skin, the mouth, the eyes, the ears or the nose. However, when the mask ((e.g., M17A1 or M17A2) which covers the head completely) is worn, it is extremely difficult for soldiers to see their target. Further, using an NBC type mask during battle with a weapon (such as the M16 rifle) has proven to be an arduous task. This is because the NBC mask prevents the soldier from using, as intended, the standard sighting already built into the weapon (e.g., up close the eyes, so that the eyes can focus on the built-in sight device on the M16 and aim effectively towards the intended target). Further, the NBC mask introduces a skewing factor, so that when an M16 rifle is used the built-in target sights do not accurately point in the direction of the intended target. Thus, many if not all soldiers, are placed at great risk that the attempted sighting device built into their M16 rifle leads to greatly decreased accuracy in firing when protective masks are worn.

U.S. Pat. No. 4,962,589 to La Rosa discloses an offset sighting device, primarily intended for use with a M16 rifle. The 10 device includes a clamping section 16 and a sighting bar 18. The clamping section 16 includes a base plate 20 onto which the sighting bar 18 is secured. In operation, when a situation calls for the donning of chemical protective clothing and masks, the soldier would, as soon as he or she is fully clothed, install the sighting device 10. See col. 3, 11 56–61. When not in use, device 10 is removed to prevent damage, such as bending of plate 20, which would render the sighting devise ineffective and necessitate replacement. See col. 4, 11 6–20. There is no known military or civilian use of the devise of La Rosa.

It is an object of the present intention to provide an improved offset sighting device which overcome the deficiencies of the sighting device of La Rosa.

More specifically, it is an object of the present invention to provide a sighting device which is neither bulky nor cumbersome to use.

It is a further object of the invention to provide a sighting device which light, smaller in size than that of LaRosa, yet much more rugged.

It is a further object of the present invention to provide a sighting device which is quickly, easily and securely mounted to the handle of the M16, and is protected by the handle of the M16.

It is an additional object of the present invention to provide an offset sighting device which can be mounted on the M16 at all times without being damaged, and does not effect the normal use of the M16.

It is yet an additional object of the present invention to provide an offset sight in which it is much easier for the user to determine his or her individual sight requirements.

It is also a further object to provide an offset sighting device which holds the sight device in a much more secure fashion.

It is also a further object to provide an offset sight which is compact when not in use and, when not mounted to a weapon, is easily stored.

It is also a further object of the invention to provide an offset sighting device in which the sighting components fold in the supporting frame when not in use, to minimize space and permit the device to be secured to the weapon at all times, without interfering with any functions of such weapon.

Additional objects, advantages and novel features of the invention will be set forth in part in the description that follows, and in part will become apparent to those of skill in the art upon examination of the following description or may be learned by practice of the invention. The objects and advantages of the invention may be realized and attained by means of the instrumentalities and combinations set forth below.

SUMMARY OF THE INVENTION

The invention is directed to an offset sighting device for a weapon such as an M16 rifle for use with an NBC mask or equivalent. The sighting device includes front sight, rear sight, and a mechanism for supporting both. The site support includes a bracket, and a front sight support arm pivotally connected to the bracket to permit the front sight to be moved from a closed position adjacent to the bracket to an operational position. The sight support further includes a rear right support arm pivotally connected to the bracket to permit the rear sight to be moved from a position adjacent to the bracket to an operational position in alignment with the front sight. The sighting device also includes a mechanism for attaching the bracket to the rifle. Preferably, the bracket is an elongated member having first and second ends and a generally U-shaped cross section. The front sight support arm is attached to the first or front end of the bracket and the rear sight support arm is attached to the second or back end of the bracket. Additionally, the bracket includes a first means to yieldably hold the front sight support arm in both the closed position and the operational position. The bracket includes second means to yieldably hold the rear sight support arm in both the closed position and the open/operational position. The first yeieldable holding means is a first leaf spring formed integrally with the bracket and biased into engagement with the front sight support arm. The second yiedable holding means is a second leaf spring formed integally with the bracket and biased into engage with the rear sight support arm. The front sight support arm includes surfaces which cooperate with the first leaf spring to yieldably hold the front sight in, alternately, the closed position and the operational position. The back sight support arm also includes surfaces which cooperate with the second leaf spring to yieldably hold the back sight in, alternately, the closed position and the operational position. The front sight is an adjustable sighting pin, and the rear sight is an adjustable peep sight. The front sight support arm is rotated through an arc of, approximately 90°, and said rear sight support arm is rotated through an arc of approximately 90°.

DETAILED DESCRIPTION OF THE INVENTION

Figure 1:
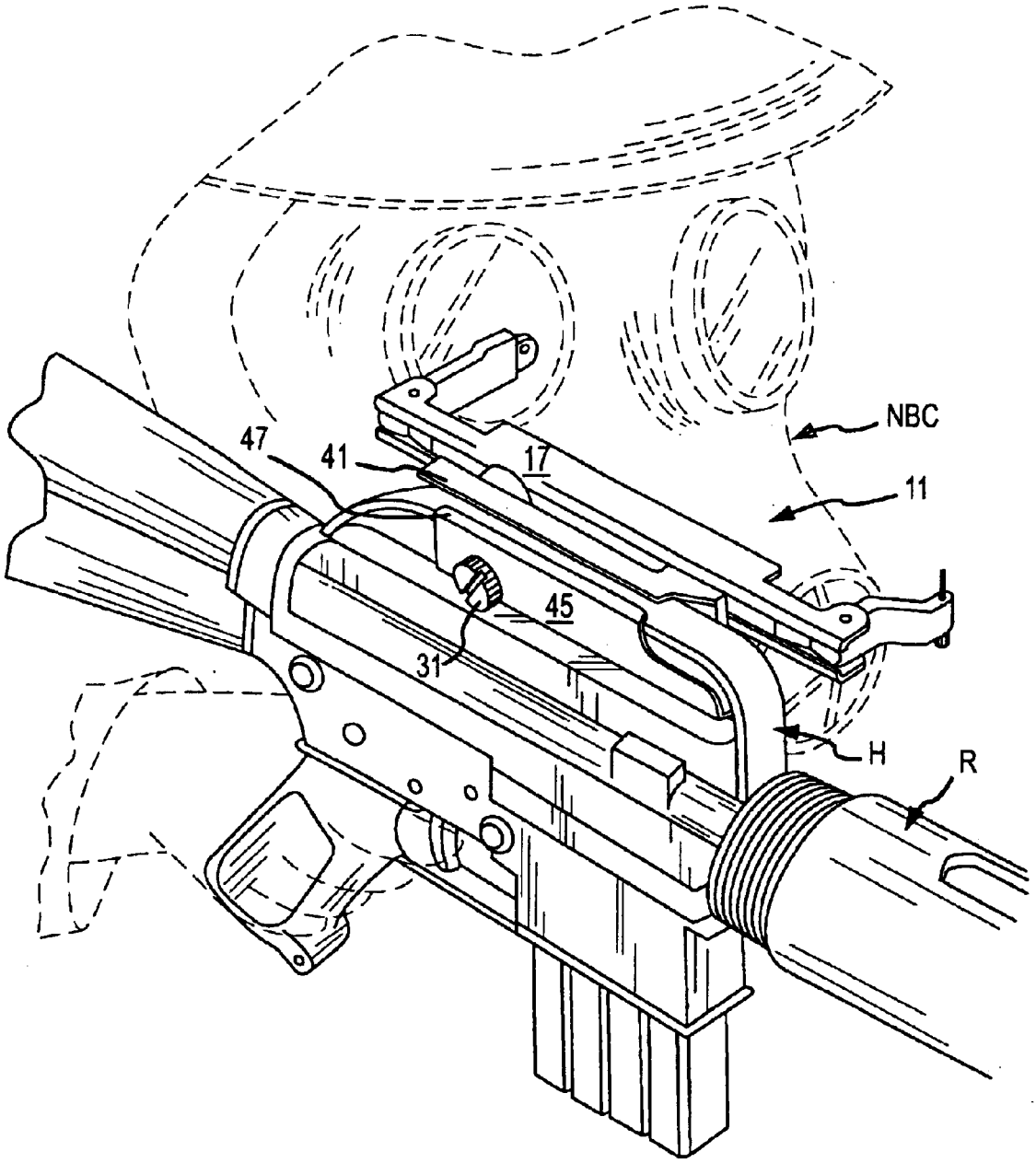
FIG. 1 is a side perspective view of the present invention attached to an M16 rifle as it would be used by a soldier wearing an NBC type mask.

The present invention is a removable offset sighting device 11 particularly suited for detachable attachment to the handle H of the weapon (such as an M16 series rifle designated R) as seen in FIG. 1 when used by a soldier wearing an NBC type mask.

Figure 2:
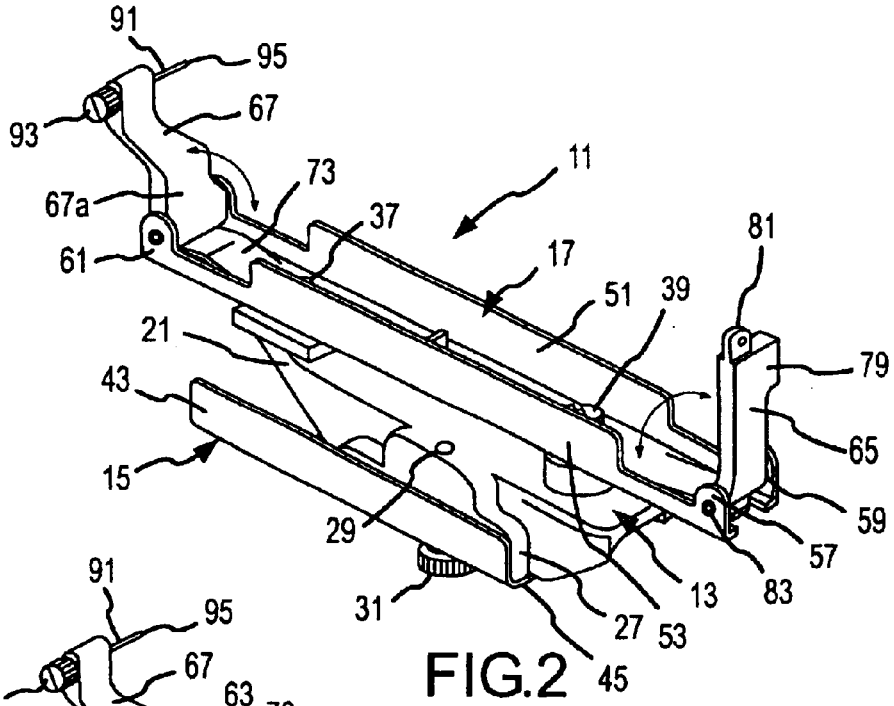
FIG. 2 is a bottom side perspective view of the present invention.
Figure 3:
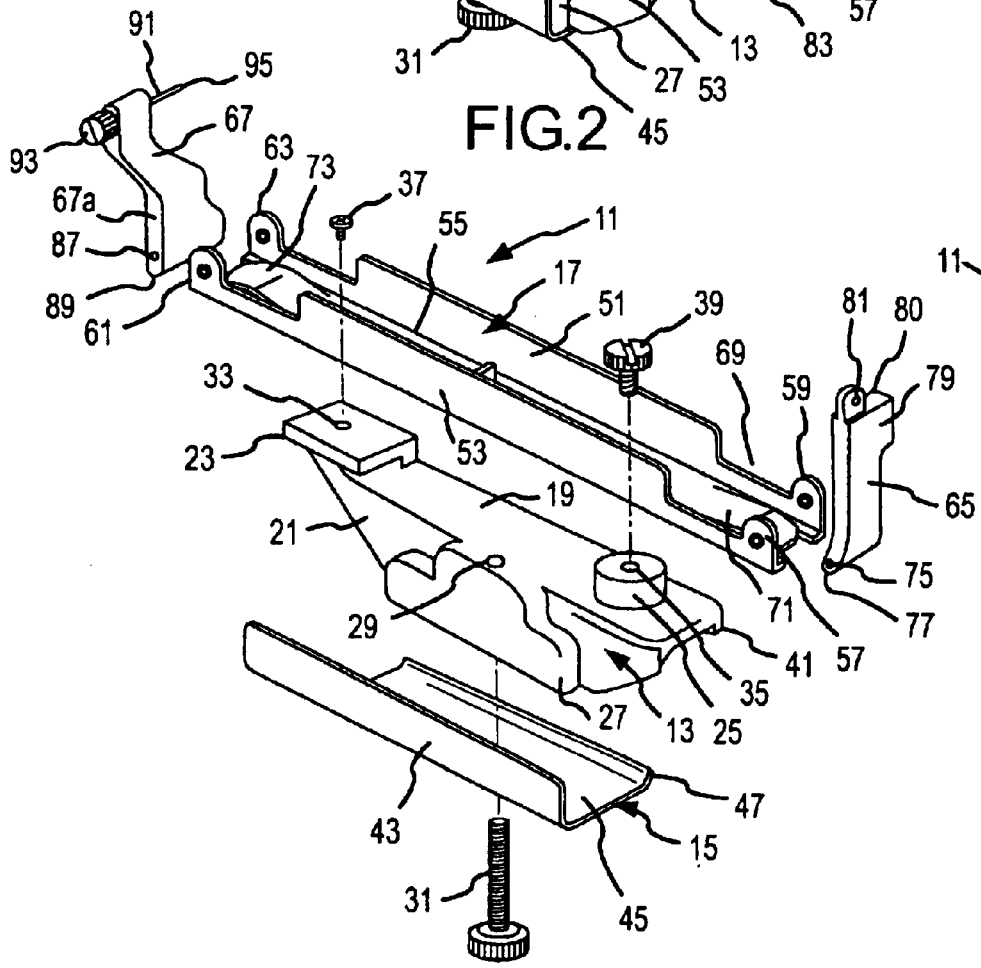
FIG. 3 is an exploded perspective view of FIG. 2.
Figure 4:
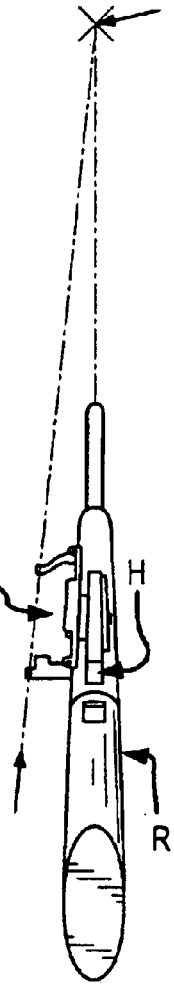
FIG. 4 illustrates the present invention in offset alignment with the barrel of an M16, and showing the aiming alignment for a specific remotely located target.

With reference to FIGS. 1–3, offset sighting devise 11 includes a base 13, an attachment bracket 15, and sight support bracket 17. Base 13, which is preferable manufactured from die cast aluminum, includes a body portion, having a generally L shaped cross section, formed of legs 19 and 21. Leg 19 includes a front post 23 and a rear post 25. Leg 21 includes a thickened section 27, which has a drilled and tapped hole 29 for receiving thumb screw 31. Posts 23 and 25 also include drilled on tapped holes as indicated at respectively, 33 and 35, for receiving screws 37 and 39. The exposed surfaces of posts 23 and 25 are coplanar. Though not illustrated, leg 21 also includes, on the side opposite to thickened area 27, a groove dimensioned to engage a portion of the underside of handle H of M16 rifle R. Though also not illustrated, leg 19 includes a tapered grove which engages a side portion of handle H. The lip of this grove is illustrated at 41 in FIG. 3.

Bracket 15 is, essentially, a stamped piece of metal (e.g. steel) having a generally L shaped cross-section formed of legs 43 and 45. When assembled, the interior surface of leg 43 engages the exterior surface of thickened area 27, as best illustrated in FIG. 2. Leg 45 includes a hole (not illustrated) for receiving thumb screw 31, and a lip 47 which, when assembled and clamped to handle H, is in opposing relationship to lip 41. See FIG. 1.

Sight support bracket 17 is, preferably, formed of metal and includes a basically U-shaped channel formed of legs 51 and 53 and center section 55. Legs 51 and 53 include 2 sets of opposing ears 57, 59 and 61, 63, for supporting peep sight support 65 and sight pin support 67. Legs 51 and 53 also include four cut-out areas, one of which is identified with references number 69. See FIG. 3. Center section 55 includes holes (not shown) for receiving screws 37 and 39, to secure bracket 17 to base 13. The opposite ends of section 55 include integral leaf springs 71 and 73 for, as discussed below, holding the sights in, respectively, their open/operative position and the folded/closed position.

Peep sight support 65, also typically manufactured of metal (e.g., aluminum), includes a through hole 75, a flattened end surface 77, tab 79, a peep sight support 80, and a peep hole sight 81. Support 65 is secured to ears 57, 59 by a pin (not shown) which passes through holes such as identified at 83 (in FIG. 2). The parts are so dimensioned and holes so located that, when assembled, flattened end surface 77 is in engagement with and yieldably held in place by the tab end of spring 71 (such as illustrated in FIG. 2.) As is also evident in FIG. 2, support 65 is movable from the operational position illustrated to a closed position, through an approximate 90 degree arc, to a position where it is received within the u-shaped channel, with tab 79 received in cut-out area 69 and projecting above the outside surface of leg 51. Though not illustrated, peep sight support 80 is adjustable, inwardly and outwardly relative to support 65, to tune sighting device 11 to the individual shooters requirements and adjust for windage.

Sight pin support 67, also made of metal, includes a through hole 87, a flattened end surface 89 and a sight pin 91. As with support 65, support 67 is secured to ears 61, 63 by a pin (not shown) which passes through the holes therein. Again, the parts are so dimensioned and the holes so located that, when in place, flattened end surface 89 is engagement with and yieldably held in place by the free (tab) end of spring 73. See FIG. 2. Sight pin 91, located at the free end of support 67 includes and slotted and knurled end 93, a pin end 95 and an intermediate threaded section (not shown which is received in a threaded hole in support 67 (also not shown). As is evident from FIG. 2, sight pin supported 67 is rotated, through an arc of approximately 90 degrees between the illustrated operational position to a position where the portion 67*a* is received within the u-shaped channel (formed by legs 51 and 53 and center section 55) and sight pin 91 is adjacent thereto.

Offset sighting device 11 is stored with both peep sight support 65 and right pin support 67 folded into the u-shaped channel of sight support bracket 17. The tab ends of springs 71 and 73 engage portions of, respectively supports 65 and 67, and yieldably hold them in the closed (compact) position. In operation, device 11 is installed on handle H by engaging the grooves provided on the inside of legs 19 and 21 of base 13 with the side and underside of handle 17. As the grove in leg 19 is tapered to match the tapered thickness of handle H, base 13 will always be positioned on the same portion of handle H. Once in position, bracket 15 is moved into engagement with the opposite side of handle H and thumb screw 31 tightened. Further tightening can be achieved by use of a screw driver slot (not shown) provided in thumb screw 31. Once secured to handle H, supports 65 and 67 are flipped to their operational position and the sight ready for use, as illustrated in FIG. 1. Installation is accomplished in the order of 15 seconds. The front sight is adjusted by rotating knurled and slotted end 93, of sight pin 91, either clockwise or counter clockwise as is required for the individual user and the target distance. Because of the fine threads on pin 91 and in support bracket 67, and the use of a nylon type plug (not shown) in the threads, the adjustment will be maintained until re-adjusted. Peep sight support 80 is moved in or out (by a mechanism not illustrated) to adjust the position of peep sight 81. Typically, the sights are spaced 5–6 inches apart. Unlike the LaRosa design, when not in use sighting device 11 can be maintained safely on handle H without compromising accuracy, simply folding in support brackets 65 and 67.

Variations and modifications of the present invention will be apparent to those ordinary skill in the art, and it is the intent of the appended claims that such variations and modifications be covered. The particular values and configurations discussed above can be varied, are cited to illustrate the preferred embodiment of the present invention, and are not intended to limit the scope of the invention. It is contemplated that the use of the present invention can involve components having different characteristics as long as the principles are followed.

I claim:

1. A compact, foldable offset sighting device for attachment to a shoulder fired weapon for sighting such weapon where the user of said weapon is wearing an NBC mask or equivalent, said sighting device comprising:

a) a front sight;

b) a rear sight;

c) means for supporting both said front sight and said rear sight, said sight support means including a bracket means, said sight support means further including a front sight support arm pivotally connected to said bracket means to permit said front sight to be moved from a closed position adjacent to said bracket means to an operational position, said sight support means further including a rear sight support arm pivotally connected to said bracket means to permit said rear sight to be moved from a position adjacent to said bracket means to an operational position in alignment with said front sight; and d) means for fixedly attaching said bracket means to said shoulder fired weapon such that said bracket cannot pivot relative to said shoulder fixed weapon.

2. The sighting device of claim 1, wherein said bracket means is an elongated member having first and second ends.

3. The sighting device of claim 2, wherein said front sight support arm is attached to said first end of said bracket means, and said rear sight support arm is attached to said second end of said bracket means.

4. The sighting device of claim 3, wherein said bracket means includes first means to yieldably hold said front sight support arm in both said closed position and said operational position.

5. The sighting device of claim 4, wherein said bracket means includes second means to yieldably hold said rear sight support arm in both said closed position and said operational position.

6. The sighting device of claim 5, wherein said first yeieldable holding means is a first leaf spring formed integrally with said bracket means and biased into engagement with said front sight support arm, and said second yieldable holding means is a second leaf spring formed integrally with said bracket means and biased into engage with said rear sight support arm.

7. The sighting device of claim 6, where said front sight support arm includes surfaces which cooperate with said first leaf spring to yieldably hold said front sight in, alternately, said closed position and said operational position.

8. The sighting device of claim 6, where said back sight support arm includes surfaces which cooperate with said second leaf spring to yieldably hold said back sight in, alternately, said closed position and said operational position.

9. The sighting device of claim 5, wherein said front sight is a sighting pin.

10. The sighting device of claim 9, wherein said sighting pin is adjustable.

11. The sighting device of claim 9, wherein said rear sight is a peep sight.

12. The sighting device of claim 5, wherein said front sight support arm is rotated through an arc of, approximately 90°, and said rear sight support arm is rotated through an arc of approximately 90°.

* * * * *